United States Patent [19]

Konecny

[11] 4,261,233

[45] Apr. 14, 1981

[54] RATCHET WRENCH OF THE SOCKET DRIVE TYPE

[75] Inventor: James W. Konecny, Fort Worth, Tex.

[73] Assignee: Thorsen Tool Company, Dallas, Tex.

[21] Appl. No.: 9,462

[22] Filed: Feb. 5, 1979

[51] Int. Cl.[3] ..... B25B 13/46

[52] U.S. Cl. ..... 81/62; 192/43.1

[58] Field of Search ..... 81/60–63.2; 192/43.1

[56] References Cited

U.S. PATENT DOCUMENTS

| | | | |
|---|---|---|---|
| 376,584 | 1/1888 | Cone | 192/43.1 |
| 4,147,076 | 4/1979 | Wright et al. | 192/43.1 |

*Primary Examiner*—James L. Jones, Jr.

*Attorney, Agent, or Firm*—Wm. T. Wofford

[57] ABSTRACT

A ratchet wrench of the socket drive type has an improved ratchet pawl configuration which significantly reduces excessive wear and various attendant problems and also obviates the problem of accidental wrench disassembly. Improved structure also provides certain further advantages.

6 Claims, 13 Drawing Figures

RATCHET WRENCH OF THE SOCKET DRIVE TYPE

FIELD OF THE INVENTION

The invention relates to ratchet wrenches and more particularly to improved ratchet wrenches of the socket drive type.

BACKGROUND OF THE INVENTION

One of the most common types of mechanic's wrenches currently in use is the socket with a ratchet drive. The ratchet drive accommodates a number of sockets having a range of sizes to make up a set. A selected socket is received on a drive stud and is normally retained thereon by means of a detent device. Ratchet drives of the prior art of which I am aware, and particularly their ratchet pawls, have been susceptible to excessive wear. Such prior art ratchet drives have also had other problems including being subject to accidental disassembly under certain conditions; being subject to ratchet pawl failure under certain conditions; and requiring strict manufacturing tolerances.

It is accordingly the general object of the present invention to provide an improved ratchet wrench of the type utilizing sockets with a ratchet drive.

Another object of the present invention is to provide, for ratchet wrenches utilizing sockets with a ratchet drive, a ratchet pawl having an improved configuration which results in significant reduction of excessive wear and the attendant problems.

Another object of the present invention is to provide an improved ratchet wrench of the type utilizing sockets wherein the problem of accidental disassembly is obviated.

Another object of the present invention is to provide an improved ratchet wrench of the socket drive type wherein problems with ratchet pawl failure under certain conditions are obviated.

Another object of the present invention is to provide an improved ratchet wrench of the socket drive type wherein the strictness of required manufacturing tolerances is significantly reduced.

For a further understanding of the invention and further objects, features, and advantages thereof, reference may now be had to the following description, taken in conjunction with the accompanying drawings.

DESCRIPTION OF PREFERRED EMBODIMENT

Figure 1:
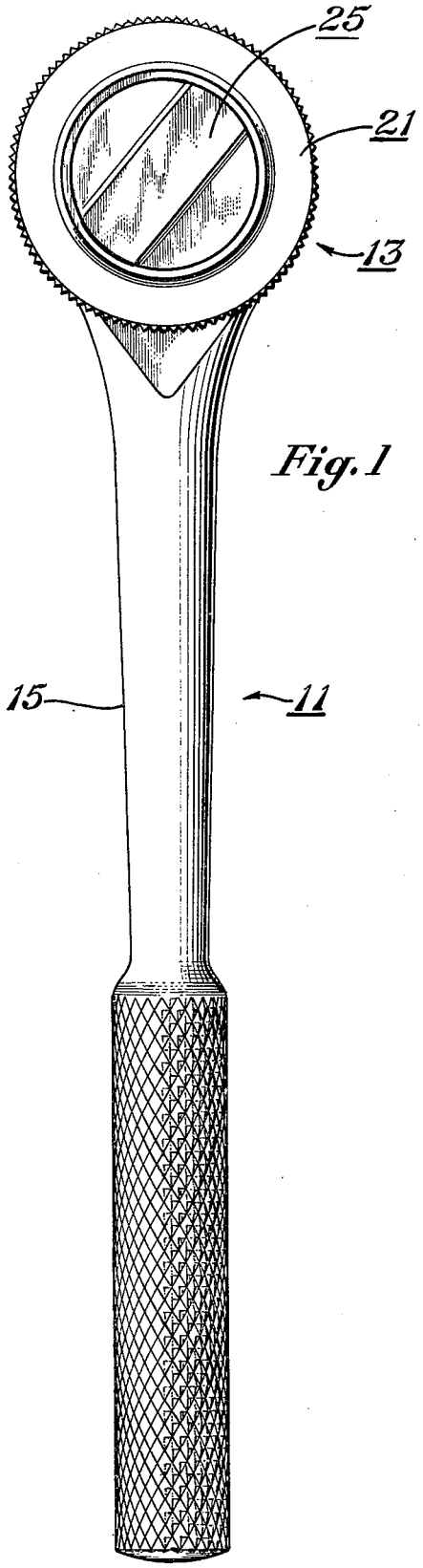
FIG. 1 is a top plan view of a typical ratchet wrench with socket drive and incorporating socket ejector means, in accordance with a preferred embodiment of the invention.
Figure 2:
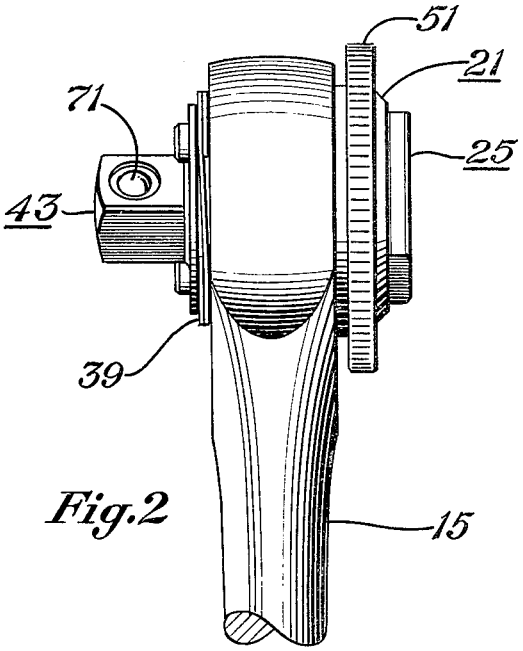
FIG. 2 is a side elevational view of the ratchet wrench of FIG. 1, without a socket installed and with a portion of the handle removed.

For convenience, a ratchet wrench with socket drive which incorporates improvements in accordance with a preferred embodiment of the invention will first be described and then the improvements will be discussed.

Referring now to the drawings it can be seen that the ratchet drive is made up of a handle 11 and a ratchet plug assembly 13. The handle 11 has a lever portion 15 which is integrally merged with a cylindrical head portion 17. The cylindrical head portion 17 has a central bore with spline-like teeth 19 formed therein.

The ratchet plug assembly 13 (see FIGS. 3 and 4) includes ratchet plug 21, ratchet pawl 23, control knob 25, ratchet reversing pin 27, reversing pin bias spring 29, first socket ejector pin 31, second socket ejector pin 33, ejector pin retainer plate 35, control knob return spring 37 and ratchet plug assembly retainer ring 39.

The ratchet plug 21 comprises a generally cylindrical body portion 41 and a drive stud portion 43. The cylindrical body portion 41 comprises a cylindrical exterior portion 45, a retainer ring groove 47, a bearing shoulder 49, a spinner control flange 51, a control knob recess 53, a control knob bore 55, a ratchet pawl slot 57, first and second ejector pin bores 59, 61, and a drive stud end surface 62.

The cylindrical exterior portion 45 has a diameter that is slightly less than the minor diameter of the spline-like teeth 19 of the handle head portion 17 and a length that is substantially equal to that of the spline-teeth 19. The cylindrical exterior portion 45 merges at one end with the retainer ring groove 47 and at the other end with the bearing shoulder 49 which in turn merges with the spinner control flange 51. The ratchet pawl slot 57 has parallel side faces that are spaced a distance slightly greater than the width of the ratchet pawl 23 and bottom surfaces that lie in a plane parallel to and passing near the central axis of the ratchet plug 21. The ratchet pawl slot 57 is closely adjacent the retainer ring groove 47, which in turn is closely adjacent the body portion drive stud end surface 62. The end surface 62 is generally planar and is perpendicular to the ratchet plug central axis.

The control knob has a head portion 63 and a stub shaft portion 65. The head portion 63 has the shape of a disc, the top surface of which merges with an integral generally rectangular boss 67. The stub shaft portion 65 is cylindrical and is coaxial with the head portion 63.

The control knob recess 53 is cylindrical; is coaxial with the ratchet plug 21; has a diameter slightly greater than that of the control knob head portion 63; and has a planar bottom surface 69 that is perpendicular to the ratchet plug central axis. The control knob bore 55 is cylindrical; is coaxial with the ratchet plug 21; has a diameter slightly greater than that of the control knob stub shaft portion 65; and merges at its open end with the control knob recess bottom surface 69. The first and second ejector pin bores 59, 61 are cylindrical; have the same diameters, which are slightly greater than those of the ejector pins 31, 33; are disposed on opposite sides of the control knob bore 55; have their axes parallel to that of the control knob bore 55; open at one end to the control knob recess bottom surface 69 and at the other end to the drive stud end surface 62 of the cylindrical body portion 41. A plane containing the axes of the ejector pin bores 59, 61 is perpendicular to a plane containing the bottom surface of the ratchet pawl slot 57.

The drive stud portion 43 of the ratchet plug 21 is integral with the cylindrical body portion 41; extends outwardly from the drive stud end surface 62; is coaxial with the ratchet plug 21; has the conventional generally square transverse section shape; is dimensioned to receive the sockets of a set having the corresponding drive size; and is provided with the conventional detent ball 71 and spring (not shown).

The ratchet pawl 23 has a generally arcuate outer surface having a set of axially extending spline-like teeth 73, 74 at each end portion thereof; an inner surface having an axially extending center notch portion 75 with a respective planar portion 77, 79 extending outwardly from each side of the notch portion; a rocker bore 81 extending axially of the ratchet pawl 23 and opening to respective parallel planar pawl side faces 83, 85 with the rocker bore axis being parallel to said spline-like teeth 73, 74 and lying in a plane that bisects the ratchet pawl 23.

The first and second ejector pins 31, 33 are alike and each have a cylindrical exterior surface portion 87 and a flanged head portion 89. The ejector pin retainer plate 35 has a generally rectangular shape with tapered ends; a pair of oppositely disposed end slots 91 and a side slot 93.

To assemble the ratchet plug assembly 13, the respective ejector pins 31, 33 are mounted in the retainer plate end slots 91 which conform with the pin exterior surface portions 87 and space the pins in alignment with the ejector pin bores 59, 61. The retainer plate 35 is then mounted to the control knob 25, with the side slot 93 being conformingly received by a peripheral groove 97 at the inner end of the control knob stub shaft portion 65. The width of the peripheral groove 97 is such that the ejector pin heads 89 are in substantially abutting relation to the inner face 99 of the control knob head portion 63. Next, the ratchet reverse pin 27 and its bias spring 29 are inserted in a transverse bore 101 in the control knob stub shaft portion 65 and the control knob return spring 37 is inserted in the control knob bore 55. Next, the control knob 25, with attachments, is inserted in the ratchet plug control knob recess 53 (see FIGS. 3 and 4); with the ejector pins 31, 33 having been received by the ejector pin bores 59, 61; with the first ejector pin 31 having been passed through the ratchet pawl rocker bore 81, the ratchet pawl having been correctly positioned in the ratchet pawl slot 57; with the ratchet reverse pin 27 having been compressed so as to pass through the control knob bore 55 and then extended so as to bear against the ratchet pawl inner surface; and with the control knob return spring 37 having been received at its outer end by a locator 103 in the outer end of the control knob stub shaft portion 65 and having been compressed so as to bias the control knob 25 to move in the outward direction until the ratchet reversing pin 27 bears against a side face 95 of the ratchet pawl slot 57, at which time the outer surface of the control knob head 63 is substantially flush with the surface of the spinner control flange 51.

To assemble the ratchet plug assembly 13 onto the handle 11, the ratchet plug cylindrical exterior portion 45 is inserted into the bore of the handle cylindrical head portion 17 until the bearing shoulder 49 abuts one side face 105 of the handle cylindrical head portion 17, at which time the retainer ring groove 47 will extend outwardly just beyond the other side face 107 of the handle cylindrical head portion 17. The ratchet plug assembly retainer ring 39 is then installed in the retainer ring groove 47. The ratchet retainer ring may be a conventional commercially available type made of spring strip material formed to have the shape of a circular flat spiral, as shown. The retainer ring 39 can be expanded radially to increase its inner diameter sufficiently to pass over the periphery of the drive stud end surface 62 and then will relax so that its inner diameter will substantially conform to the bottom of the retainer ring groove 47. When the retainer ring 39 is installed, its inner side surface will bear against the adjacent side face 107 of the handle cylindrical head portion 17 so as to substantially prevent axial movement of the ratchet plug assembly 13. When inserting the ratchet plug assembly 13 into the bore of the handle cylindrical head portion 17 it is necessary to rock the ratchet pawl 23 slightly in a direction to compress the ratchet reverse pin bias spring 29, which then permits the teeth 73, 74 of the pawl 23 to pass into the bore of the handle cylindrical head portion 17. When installing pressure on the pawl 23 is released, the bias spring 29 acting on the ratchet reversing pin 27 will rock the ratchet pawl 23 so that its respective teeth 73 or 74 are in proper engagement with the spline-like teeth 19 of the handle cylindrical head portion 17.

Figure 3:
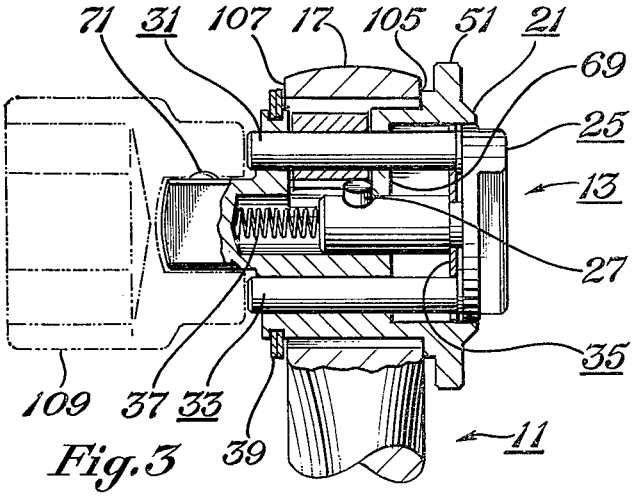
FIG. 3 is a side elevation view, partly in section and partly cut away, showing the interior of the drive assembly of the ratchet wrench of FIG. 2, with a socket ejector in the retracted position and with a socket (shown in phantom) in working position on the drive stud.
Figure 4:
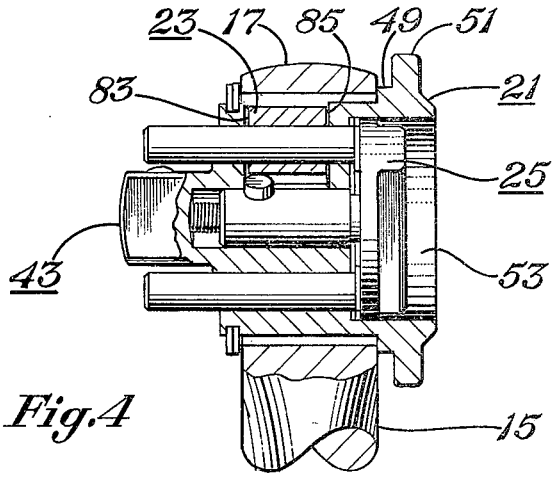
FIG. 4 is like FIG. 3, but with the socket ejector in the extended or ejecting position (the socket has been ejected).
Figure 5:
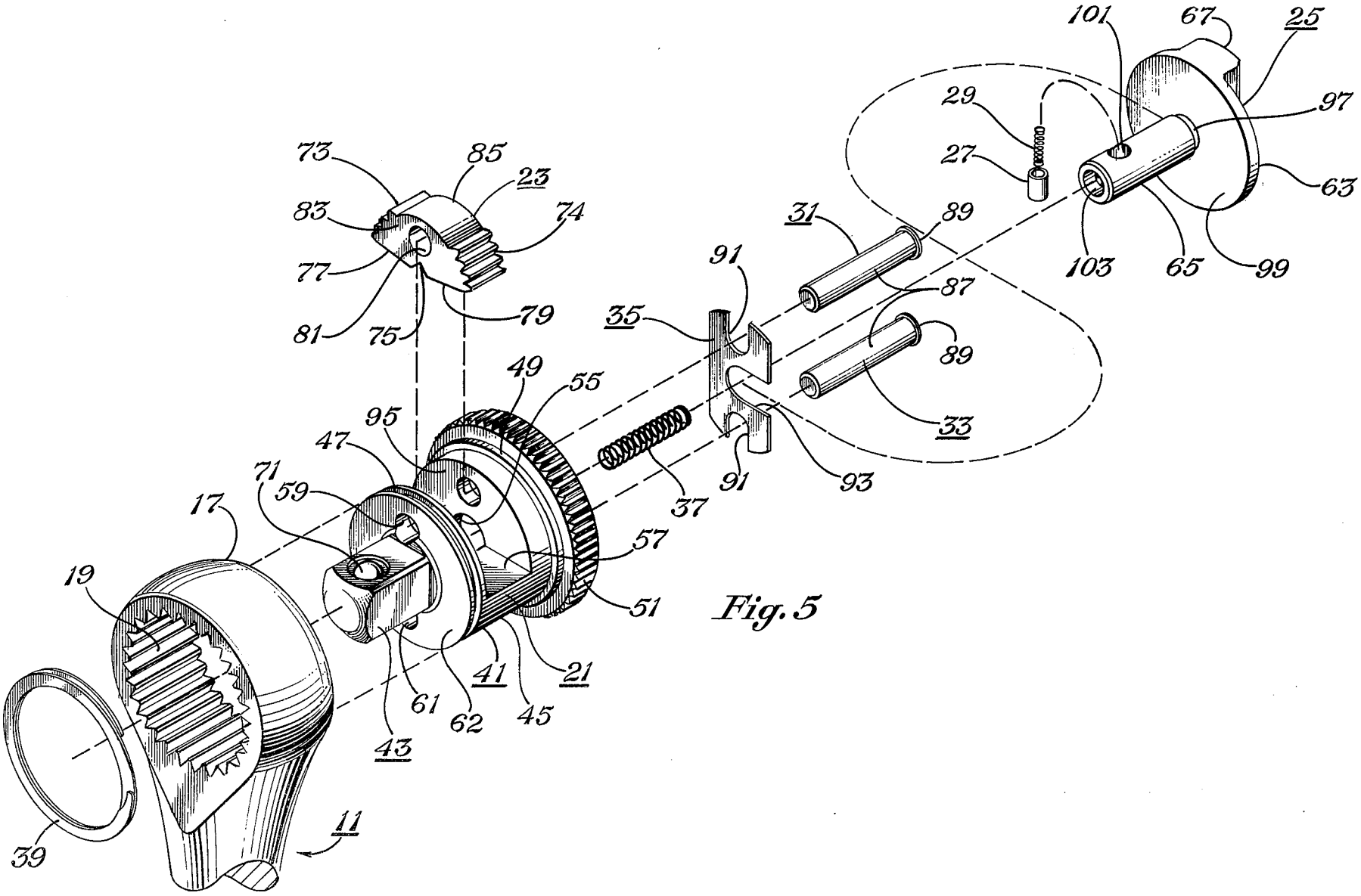
FIG. 5 is an exploded perspective view of the ratchet drive assembly.

In operation, a socket 109 (shown in phantom in FIG. 3) is installed on the drive stud portion 43 and is held in place in a conventional manner by action of the detent ball 71. The control knob 25 is then in the ejector pin retracted position and the ratchet pawl 23 (as shown by FIG. 3) is in the drive clockwise and ratchet counter clockwise position. To drive counter clockwise and ratchet clockwise the control knob 25 is simply rotated to its extreme clockwise position, causing the ratchet reverse pin 27 to shift its position on the inner surface of the ratchet pawl 23 so as to pivot the ratchet pawl on the first ejector pin 31 so as to disengage one set of pawl teeth 74 and engage the other set 73. To eject the socket 109, the control knob 25 is depressed to the ejector pin extended position (see FIG. 4) and the socket 109 is pushed by the ejector pins 31, 33 out of engagement with the detent ball 71 and off the end of the drive stud 43.

Figure 6:
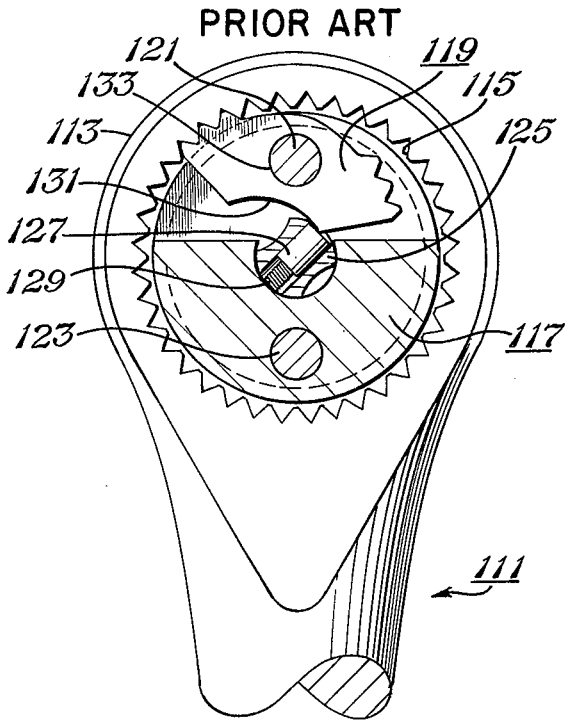
FIGS. 6 and 7 are top plan views of a typical ratchet drive of the prior art, with portions cut away to show the ratchet pawl and coacting parts.

The essence of the present invention resides in an improved ratchet pawl configuration. To aid in the explanation of some of the advantages of the improved ratchet pawl configuration, it will be helpful to refer to FIGS. 6 and 7 wherein there is shown a ratchet wrench having a ratchet pawl configuration which is typical of the prior art. The ratchet wrench of FIGS. 6 and 7 includes a handle 111 having a cylindrical head portion 113 with a central bore having spline-like teeth 115 formed therein, a ratchet plug 117, a ratchet pawl 119, first and second socket ejector pins 121, 123, a control knob stub shaft portion 125, a ratchet reversing pin 127 and a reversing pin bias spring 129.

Figure 7:
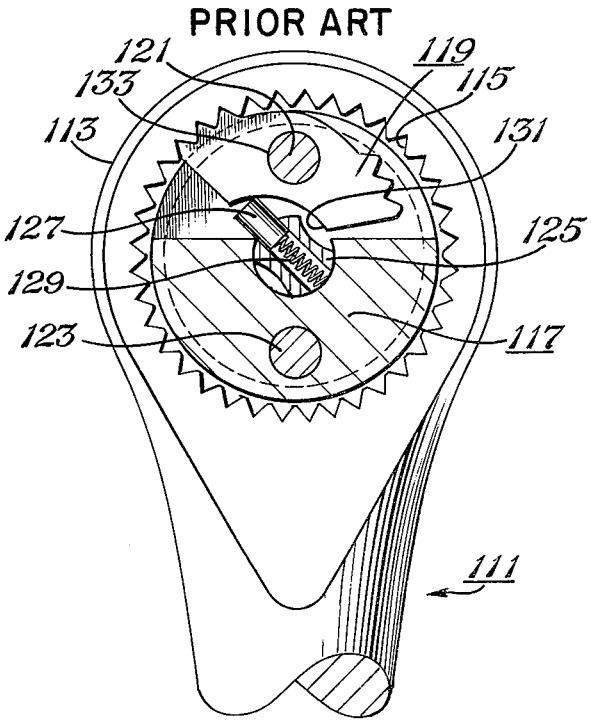

In FIG. 7, the prior art device is shown with the ratchet pawl 119 positioned for the torquing of the ratchet wrench in the clockwise direction and ratcheting in the counter clockwise direction. The ratchet pawl 119 has an arcuate inner surface 131 which coacts with the ratchet reversing pin 127. The ratchet reversing pin 127 is urged into constant contact with the arcuate surface 131 by the action of the reversing pin bias spring 129. The ratchet reversing pin 127 is cylindrical and has a circular end face, which means that the area of the contact between the arcuate surface 131 and the ratchet reversing pin 127 is theoretically a point, and in actual practice, is very, very small. As the ratcheting action of the wrench takes place, there is a relative short reciprocating motion between the point of contact of the reversing pin 127 and the arcuate surface 131. Since the bearing area is very, very small and the ratcheting action takes place often and repeatedly when the wrench is in use, a depression is soon worn into the arcuate surface 131 at both the clockwise and counter clockwise ratcheting position. Then, each time a reversing action takes place it is necessary that the reversing pin 127 be moved out of the respective depression before it can be traversed to the other wrench torquing position. The wrench reversing action becomes more difficult and frustrating to the operator as the respective depression is worn deeper. The useful life of the wrench is prematurely terminated when a depression is worn so deep that the reversing action becomes inoperative. In some ratchet wrenches in the prior art of which I am aware, attempts have been made to alleviate the wear problem above mentioned by changing the shape of the end portion of the reversing pin, but these attempts have not proved to be completely successful.

Another problem with prior art ratchet wrenches is that of accidental disassembly. This problem can be explained with reference to FIG. 6, wherein the ratchet pawl 119 is positioned for torquing of the wrench in the clockwise direction while the reversing pin 127 has moved to an extreme position which is clockwise beyond where it would normally be when the ratchet pawl 119 is positioned for counter clockwise torquing. Under these conditions, the clockwise end portion of the pawl arcuate surface 131 has forced the reversing pin 127 inwards so that it no longer extends beyond the periphery of the outer surface of the control knob stub shaft portion 125. This means that the wrench is free to disassemble, since it is normally retained against disassembly by the extending of the reversing pin 127 beyond the periphery of the outer surface of the control knob stub shaft portion 125.

Another problem with prior art ratchet wrenches is that under certain conditions forces can be applied to the ratchet pawl 119 in a manner that will result in pawl failure. For example, with reference to FIG. 7, if the control knob stub shaft portion 125 were not provided with the reduced transverse section shown, then torquing of the wrench could cause the end portion of the ratchet pawl arcuate surface 131 to bear against the control knob stub shaft portion 125 and thus transmit force to the ratchet pawl 119 causing it to fail in the region between the pawl rocker bore 133 and its arcuate inner surface 131. Providing the control knob stub shaft portion 125 the reduced transverse section at its central region alleviates the pawl failure problem, but only at the expense of additional manufacturing costs and a weakening of the control knob stub shaft portion 125.

The improved ratchet pawl configuration of the present invention not only obviates all of the above mentioned problems, but makes possible additional significant advantages as well. A basic feature of the improved ratchet pawl configuration is the provision of an axially extending center notch portion on its inner surface. In the embodiment shown, the center notch portion 75 has the shape of a truncated "V". The reversing pin 27 is substantially a right cylinder having a substantially planar and circular outer end face 135. The diameter of the reversing pin outer end face 135 slightly exceeds the transverse width of the truncated "V", thus precluding the simultaneous entry of more than a portion of the outer end face 135 into the notch portion 75.

Figure 9:
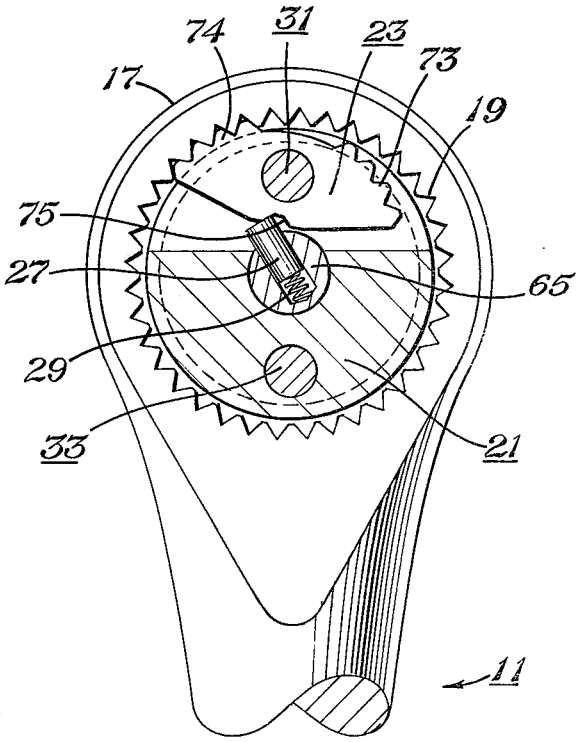
Figure 10:
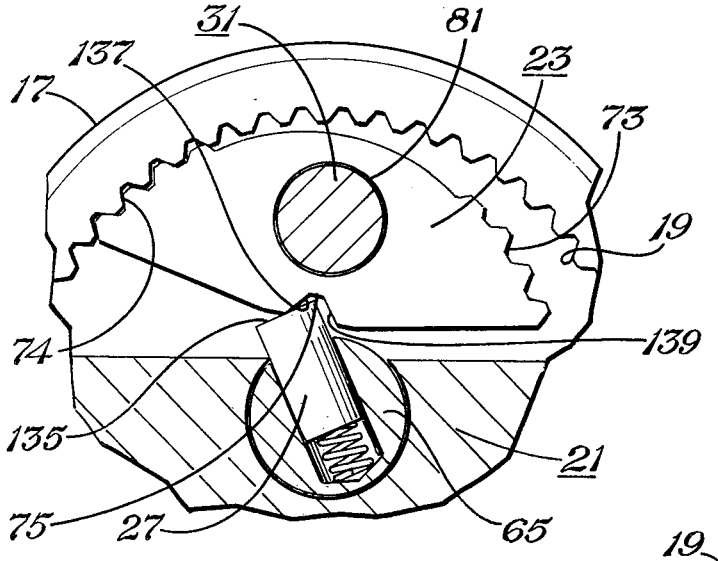
FIGS. 10, 11, 12 and 13 are enlarged fragmentary schematic top plan views showing the ratchet pawl and coacting parts of the device shown by FIG. 9 in several stages of their operation.

The operation of the improved ratchet pawl configuration may be explained with reference to FIGS. 10–13. In FIG. 10, the ratchet pawl 23 and reversing pin 27 are shown in the normal position for clockwise wrench torquing (as also shown by FIG. 9). A first set of ratchet pawl teeth 74 is engaged with the spline-like teeth 19 of the wrench handle cylindrical head portion 17, which establishes the extreme clockwise angular position (relative to its rocker pivot 31) for the ratchet pawl 23. The reversing pin 27 has been moved to its extreme counter clockwise position where its movement is stopped by the contact of its side surface with the bottom of the ratchet pawl slot 57 of the ratchet plug 21. Under these conditions, an outer edge portion of the notch portion first side face 137 is in contact with the reversing pin outer end face 135 in the region of a diameter of the reversing pin outer end face 135, and the counter force applied to the reversing pin 27 by the ratchet pawl notch portion first side face 137 is substantially parallel to the longitudinal axis of the reversing pin 27. As a result, there is no side thrust on the reversing pin 27 to cause binding and the force applied toward engagement of the first set of ratchet pawl teeth 74 is maximized. Furthermore, the contact between the reversing pin outer end face 135 and the notch portion first side face 137 is theoretically at least a line that extends always fully across the reversing pin outer end face 135, and as a practical matter is a relatively large area (particularly as compared to the corresponding contact area of the prior art devices discussed hereinbefore with reference to FIG. 7). As a consequence, the bearing load is distributed over a relatively large area of the ratchet pawl notch portion first side face 137 and the reversing pin outer end face 135, thus greatly reducing wear due to ratcheting and reversing actions. Such wear as may occur on the ratchet pawl notch portion first side face 137 will not adversely affect the wrench reversing operation.

Figure 11:
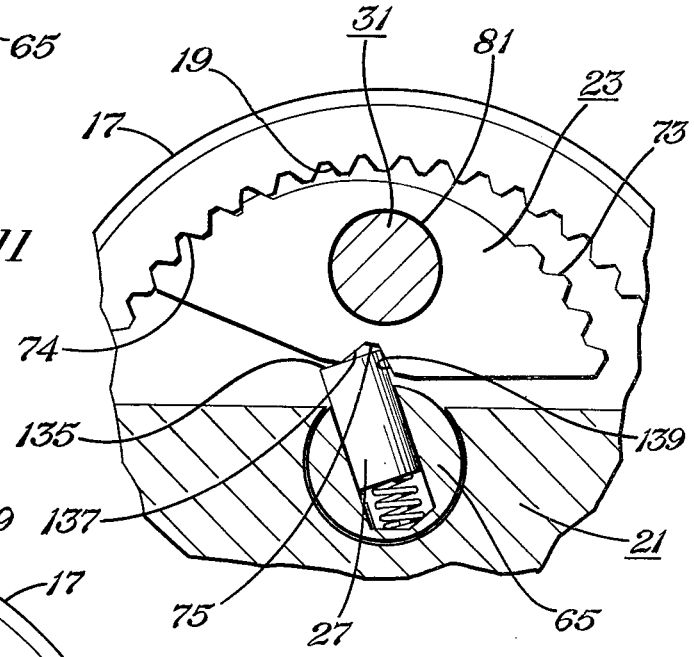
Figure 12:
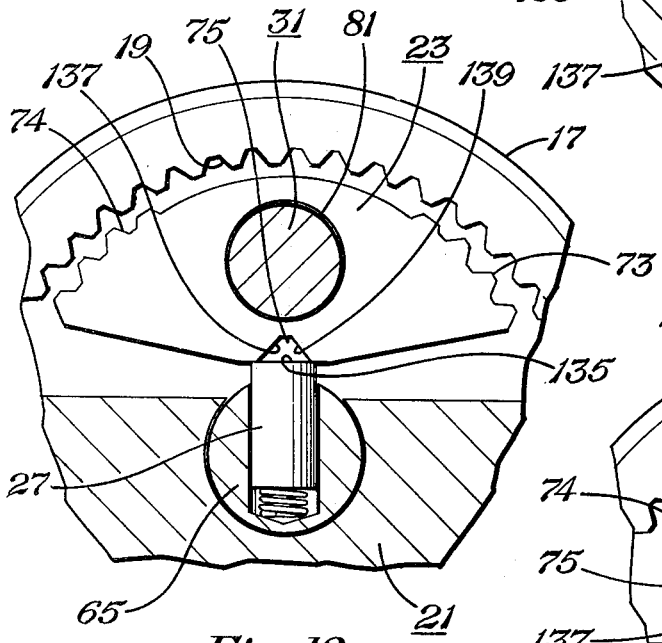
Figure 13:
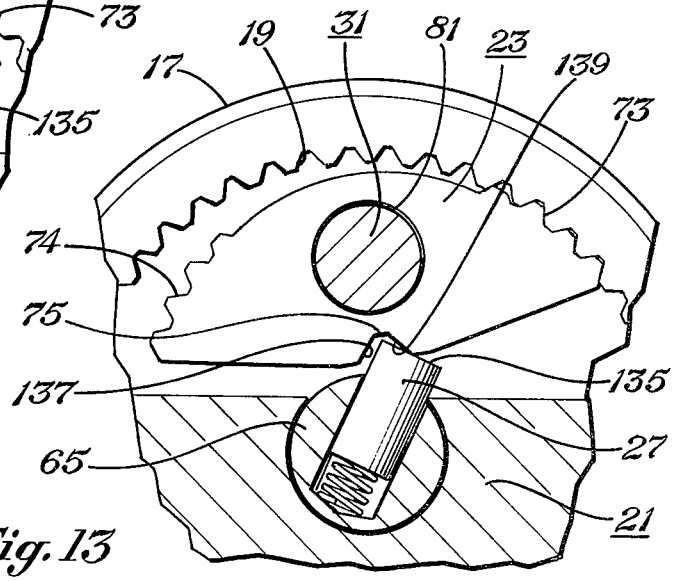

In FIG. 11, a wrench reversing operation has begun and, without disturbing the angular position of the ratchet pawl 23 (from that of FIG. 10), the reversing pin 27 has been moved clockwise to where its side surface has just made contact with the notch portion second side face 139. As the reversing pin 27 is moved further in the clockwise direction, it will positively urge the ratchet pawl 23 to pivot in the counter clockwise direction until the reversing pin outer end face 135 clears the notch portion 75, at which time neither set of ratchet pawl teeth 73, 74 is engaged and the reversing pin outer end face 135 is generally bridging the notch portion 75, as shown by FIG. 12. As the reversing pin 27 is moved still further in the clockwise direction, the reversing pin outer end face 135 moves off the outer edge of the notch portion first side face 137 and then rapidly into contact with the notch portion second side face 139 and quickly urges the second set of ratchet pawl teeth 73 into engagement with the cylindrical head portion spline-like teeth 19. Clockwise movement of the reversing pin 27 is stopped by contact of its side surface with the bottom of the ratchet pawl slot 57 of the ratchet plug 21. The wrench is now in the position for counter clockwise torquing, as shown by FIG. 13. The action of the ratchet pawl and the reversing pin 27 and their relative positions for counter clockwise torquing and clockwise ratcheting are the same as has been previously described with reference to FIG. 10.

Some typical parameters and dimensions (given in thousandths of inches) for a typical one-half inch drive size ratchet wrench embodying the principles of the present invention are: ratchet pawl notch portion—width 107, depth 52, included angle 80 degrees; handle cylindrical head portion—number of teeth 45, teeth major diameter 1218, tooth depth 28; angle through which ratchet pawl pivots from clockwise to counter clockwise engagement—20 degrees; reversing pin—length 252, diameter 125; angle through which reversing pin moves from clockwise to counter clockwise stop positions—53 degrees; distance from ratchet plug (or control knob stub shaft) pivot axis to ratchet pawl pivot axis —392.

Figure 8:
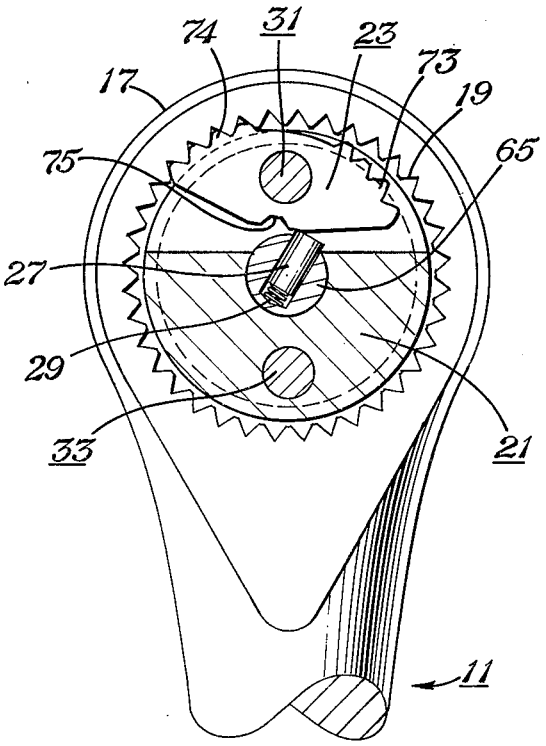
FIGS. 8 and 9 are top plan views corresponding with those of FIGS. 6 and 7, but showing the ratchet pawl and coacting parts in accordance with a preferred embodiment of the invention.

It should be apparent from the foregoing that a ratchet wrench embodying the principles of the present invention will be free of the problems of prior art ratchet wrenches hereinabove discussed. Specifically, the problem with wrench reversing action due to pawl inner surface wear is obviated. The problem of disassembly does not occur because it is not possible for the ratchet pawl and the reversing pin to assume relative positions that would force the reversing pin inwards of the outer periphery of the control knob stub shaft portion. In FIG. 8, the reversing pin 27 is shown in an extreme position relative to the ratchet pawl 23 (the likelihood of the occurrence of such a position is very remote) and yet the reversing pin 27 still extends beyond the periphery of the control knob stub shaft portion 65, so that disassembly cannot occur. The problem of ratchet pawl failure in the region between the rocker bore and the notch portion cannot occur, since the ratchet pawl cannot bear against the control knob stub shaft portion when it is being torqued, even though the control knob stub shaft portion has no reduced transverse section.

Ratchet wrenches embodying the principles of the present invention have the important advantage that they can be manufactured using liberal dimensional tolerances for the coacting parts, which can significantly reduce manufacturing costs in various ways including making possible the implementation of higher production rates with fewer defects and rejected parts, while at the same time increasing the reliability and dependability of individual parts and consequently of the whole ratchet wrench.

Another advantage of ratchet wrenches embodying the principles of the present invention is that the control knob needs to be rotated through only about 53 degrees to accomplish reversing; whereas prior art devices of the same general type require as much as 130 degrees.

While I have shown my invention in only one form, it will be obvious to those skilled in the art that it is not so limited, but is susceptible of various changes and modifications without departing from the spirit thereof.

The ratchet pawl notch portion shape is preferably a truncated "V" with substantially planar side faces, but this shape may be varied to some extent while still retaining the essential operational aspects of the device. Also, while the shape of a right cylinder is preferred for the reversing pin, this shape may be varied to some extent while retaining the essential operational aspects of the device. For example, the notch portion could be a parabolic surface having a relatively narrow bottom and side surfaces having very little curvature. It should be understood that the notch portion outer edges may be beveled. A reversing pin of rectangular, polygonal, or elliptical transverse section shape would work satisfactorily, but would require additional manufacturing expense. Some curvature of the reversing pin outer face, though not desirable, could be tolerated. The greatest dimension of the reversing pin outer face must be greater than the notch portion width, excluding any beveled outer edges, but should be only slightly greater since there is a trade off with control knob stub shaft portion strength because of the size of the bore that receives the reversing pin. The notch portion depth must be sufficient to clear the reversing pin, but by as little as possible so as to maximize the distance to the ratchet pawl rocker bore thereby maximizing the relevant transverse section area. The notch portion bottom should be flat or curved to avoid stress concentration.

It should be apparent that the present invention is equally applicable to both socket ejector and non-socket ejector types of ratchet wrenches.

The foregoing disclosure and the showings made in the drawings are merely illustrative of the principles of this invention and are not to be interpreted in a limiting sense.

What is claimed is:

1. A ratchet wrench of the socket drive type comprising:

a. a handle having a lever portion and a head portion, with the head portion having a central bore with internal spline-like teeth formed therein and oppositely disposed side faces;

b. a ratchet plug assembly installed in the head portion of said handle and including a ratchet plug with a body portion having an integral socket drive stud protruding axially outwards beyond one of said head portion side faces, and ratchet pawl means for driving or ratcheting on said spline-like teeth and reversing means therefor; with said ratchet pawl means and reversing means including:

i. a ratchet pawl having an outer surface with a set of axially extending spline-like teeth at each end portion thereof and an inner surface having an axially extending center notch portion with substantially planar side surfaces that converge in the direction toward the notch portion bottom;

ii. pivot means mounting said ratchet pawl to said ratchet plug such that said ratchet pawl may be rocked about said pivot means to engage one set of said pawl teeth for clockwise wrench torquing and the other set for counter clockwise wrench torquing;

iii. a reversing pin having a longitudinal axis extending radially of said ratchet plug and having an outer end face, with said reversing pin having a transverse dimension adjacent said outer end face which transverse dimension exceeds the greatest distance between said notch portion substantially planar side surfaces, with resilient bias means urging said reversing pin outer end face into contact with said notch portion; and iv. reversing control means to effect angular movement of said reversing pin and consequent movement of said ratchet pawl from the clockwise torquing position to the counter clockwise torquing position and vice versa.

2. The device of claim 1 wherein said reversing pin outer end face is substantially planar.

3. The device of claim 2 wherein said reversing pin is cylindrical and said reversing pin outer end face is substantially planar and circular.

4. The device of claim 1 wherein said notch portion has the shape of a truncated "V" and said reversing pin outer end face is substantially planar and normal to the pin longitudinal axis.

5. The device of claim 4 wherein said reversing pin is substantially a right cylinder and the diameter of the reversing pin outer end face diameter slightly exceeds the greatest transverse width of the truncated "V".

6. The device of either of claims 2 and 4 wherein the counter force applied to the reversing pin by one ratchet pawl notch portion side surface when said ratchet pawl is in one wrench torquing position is substantially parallel to the longitudinal axis of the reversing pin, and a side surface of the reversing pin contacts the other notch portion side surface to positively urge pivoting of said ratchet pawl as said reversing pin is moved to the other wrench torquing position.

* * * * *